US010301698B2

(12) United States Patent
Nakamura et al.

(10) Patent No.: US 10,301,698 B2
(45) **Date of Patent: *May 28, 2019**

(54) HOT-ROLLED STEEL SHEET FOR GENERATOR RIM AND METHOD FOR MANUFACTURING THE SAME

(71) Applicant: JFE STEEL CORPORATION, Chiyoda-ku, Tokyo (JP)

(72) Inventors: Nobuyuki Nakamura, Tokyo (JP); Katsumi Nakajima, Tokyo (JP); Yoshimasa Funakawa, Tokyo (JP); Kazutaka Okimoto, Tokyo (JP); Takahiko Ogura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 914 days.

This patent is subject to a terminal disclaimer.

(21) Appl. No.: 14/375,709

(22) PCT Filed: Jan. 30, 2013

(86) PCT No.: PCT/JP2013/051956

§ 371 (c)(1),
(2) Date: Jul. 30, 2014

(87) PCT Pub. No.: WO2013/115205

PCT Pub. Date: Aug. 8, 2013

(65) Prior Publication Data

US 2015/0013853 A1 Jan. 15, 2015

(30) Foreign Application Priority Data

Jan. 31, 2012 (JP) ..... 2012-018306

(51) Int. Cl.

| | |
|---|---|
| ***C21D 8/02*** | (2006.01) |
| ***C22C 38/12*** | (2006.01) |
| ***C22C 38/14*** | (2006.01) |
| ***H01F 1/16*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C21D 8/04*** | (2006.01) |
| ***C21D 8/12*** | (2006.01) |
| *C22C 38/58* | (2006.01) |
| *B22D 11/12* | (2006.01) |

(52) U.S. Cl.

CPC ..... *C21D 8/0263* (2013.01); *C21D 8/0426* (2013.01); *C21D 8/1222* (2013.01); *C21D 8/1261* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *H01F 1/16* (2013.01); *B22D 11/1206* (2013.01); *C21D 2211/004* (2013.01); *C21D 2211/005* (2013.01); *C22C 38/58* (2013.01)

(58) Field of Classification Search

CPC ..... C21D 2211/004; C21D 2211/005; C21D 8/0263; C21D 8/0426; C21D 8/1222; C21D 8/1261; C22C 38/001; C22C 38/002; C22C 38/02; C22C 38/04; C22C 38/06; C22C 38/12; C22C 38/14; C22C 38/58; H01F 1/16

See application file for complete search history.

(56) References Cited

U.S. PATENT DOCUMENTS

| | | | | |
|---|---|---|---|---|
| 4,572,748 | A | 2/1986 | Suga et al. | |
| 5,454,883 | A | 10/1995 | Yoshie et al. | |
| 5,858,130 | A | 1/1999 | Bodnar et al. | |
| 6,322,639 | B1 | 11/2001 | Matsuzaki | |
| 6,364,968 | B1 | 4/2002 | Yasuhara et al. | |
| 6,702,904 | B2 | 3/2004 | Kami et al. | |
| 7,252,722 | B2 | 8/2007 | Nakajima et al. | |
| 7,559,997 | B2 * | 7/2009 | Nakajima | C22C 38/06 148/320 |
| 7,776,161 | B2 | 8/2010 | Yoshinaga et al. | |
| 7,828,912 | B2 | 11/2010 | Okamoto et al. | |

(Continued)

FOREIGN PATENT DOCUMENTS

| | | |
|---|---|---|
| CN | 1274393 | 11/2000 |
| CN | 1520464 A | 8/2004 |

(Continued)

OTHER PUBLICATIONS

International Search Report dated May 7, 2013, application No. PCT/JP2013/051956.
Korean Office Action dated Nov. 2, 2015 for Korean Application No. 2014-7021132, including English translation.
Japanese Office Action dated Feb. 5, 2014 with English translation, application No. 2013-554129.
Chinese Office Action dated Jul. 21, 2015 in Chinese Application No. 201380007556.7, including English translation.
Extended European Search Report for European Application No. 13744071.5-1353 dated Oct. 27, 2015.
Chinese Office Action for Chinese Application No. 201480006994.6, dated Apr. 27, 2016, including Concise Statement of Search Report—19 pages 2018.

(Continued)

*Primary Examiner* — Colleen P Dunn
*Assistant Examiner* — Anthony M Liang
(74) *Attorney, Agent, or Firm* — RatnerPrestia

(57) ABSTRACT

A hot-rolled steel sheet for a generator rim contains a structure containing a ferrite phase with an areal ratio of 95% or more in which precipitates containing Ti and V whose average grain diameter is less than 10 nm are precipitated in crystal grains of the ferrite phase. The ferrite phase has an average crystal grain diameter within the range of 2 μm or more and less than 10 μm. The hot-rolled steel sheet for a generator rim has strength with a yield strength YS in a rolling direction of 700 MPa or more and electromagnetic properties with a magnetic flux density $B_{50}$ of 1.5 T or more and a magnetic flux density $B_{100}$ of 1.6 T or more.

3 Claims, No Drawings

(56) References Cited

U.S. PATENT DOCUMENTS

| | | | | |
|---|---|---|---|---|
| 9,057,123 | B2 * | 6/2015 | Takashima | B21B 1/26 |
| 9,068,238 | B2 * | 6/2015 | Ariga | C21D 8/0226 |
| 9,534,271 | B2 * | 1/2017 | Kosaka | C22C 38/001 |
| 2002/0007882 | A1 * | 1/2002 | Inoue | C21D 8/0226 148/541 |
| 2002/0088510 | A1 | 7/2002 | Nagataki et al. | |
| 2002/0148536 | A1 | 10/2002 | Nakajima et al. | |
| 2003/0063996 | A1 | 4/2003 | Funakawa | |
| 2003/0145920 | A1 | 8/2003 | Kami et al. | |
| 2004/0040633 | A1 | 3/2004 | Hansch et al. | |
| 2004/0118489 | A1 * | 6/2004 | Sun | C21D 8/021 148/602 |
| 2004/0149355 | A1 | 8/2004 | Kohno et al. | |
| 2005/0106411 | A1 | 5/2005 | Ishikawa et al. | |
| 2005/0199322 | A1 * | 9/2005 | Nakamura | C22C 38/001 148/636 |
| 2007/0144620 | A1 | 6/2007 | Soshiroda et al. | |
| 2007/0193666 | A1 | 8/2007 | Asahi et al. | |
| 2008/0060728 | A1 | 3/2008 | Kohno et al. | |
| 2009/0095381 | A1 | 4/2009 | Ariga et al. | |
| 2009/0301613 | A1 | 12/2009 | Koo et al. | |
| 2010/0108201 | A1 | 5/2010 | Yokoi et al. | |
| 2010/0196189 | A1 * | 8/2010 | Nakagawa | C21D 8/0426 420/114 |
| 2010/0319819 | A1 | 12/2010 | Kaneko et al. | |
| 2011/0192504 | A1 | 8/2011 | Kimura et al. | |
| 2012/0107633 | A1 * | 5/2012 | Nakagawa | C21D 8/0226 428/577 |
| 2013/0032253 | A1 | 2/2013 | Kariya et al. | |
| 2013/0087252 | A1 | 4/2013 | Ariga et al. | |
| 2013/0087254 | A1 * | 4/2013 | Funakawa | C21D 6/02 148/537 |
| 2013/0133790 | A1 * | 5/2013 | Ariga | C21D 8/0226 148/602 |
| 2013/0186523 | A1 * | 7/2013 | Ariga | C21D 8/021 148/507 |
| 2013/0192725 | A1 * | 8/2013 | Funakawa | C21D 1/673 148/537 |
| 2013/0213529 | A1 | 8/2013 | Kimura et al. | |
| 2013/0266821 | A1 | 10/2013 | Kawasaki | |
| 2013/0273393 | A1 | 10/2013 | Imataka et al. | |
| 2013/0319582 | A1 | 12/2013 | Yokoi et al. | |
| 2014/0000765 | A1 | 1/2014 | Nozaki et al. | |
| 2014/0000769 | A1 | 1/2014 | Takahashi et al. | |
| 2014/0141280 | A1 | 5/2014 | Kosaka et al. | |
| 2014/0238555 | A1 | 8/2014 | Funakawa et al. | |
| 2014/0363696 | A1 | 12/2014 | Funakawa et al. | |
| 2015/0030879 | A1 | 1/2015 | Kosaka et al. | |
| 2015/0030880 | A1 | 1/2015 | Kosaka et al. | |
| 2015/0083278 | A1 | 3/2015 | Kawata et al. | |
| 2015/0368740 | A1 | 12/2015 | Tagashira et al. | |

FOREIGN PATENT DOCUMENTS

| | | | |
|---|---|---|---|
| CN | 1547620 | A | 11/2004 |
| CN | 1759198 | A | 4/2006 |
| CN | 1803389 | | 7/2006 |
| CN | 1990895 | A | 7/2007 |
| CN | 101238234 | A | 8/2008 |
| CN | 101326300 | A | 12/2008 |
| CN | 101935801 | A | 1/2011 |
| CN | 102021472 | A | 4/2011 |
| CN | 102906295 | A | 1/2013 |
| CN | 102906296 | A | 1/2013 |
| EP | 0535238 | A1 | 3/1992 |
| EP | 1028167 | A2 | 8/2000 |
| EP | 1205570 | A1 | 5/2002 |
| EP | 1291447 | A1 | 3/2003 |
| EP | 1354972 | A1 | 10/2003 |
| EP | 1382703 | A2 | 1/2004 |
| EP | 1431407 | A1 | 6/2004 |
| EP | 1550797 | A1 | 8/2005 |
| EP | 1577412 | A1 | 9/2005 |
| EP | 1607489 | A1 | 12/2005 |
| EP | 1636392 | A1 | 3/2006 |
| EP | 1918396 | A1 | 5/2008 |
| EP | 1972698 | | 9/2008 |
| EP | 1978121 | A1 | 10/2008 |
| EP | 2243853 | A1 | 10/2010 |
| EP | 2431491 | A1 | 3/2012 |
| EP | 2554705 | A | 2/2013 |
| EP | 2554706 | | 2/2013 |
| EP | 2554706 | A1 | 2/2013 |
| EP | 2586885 | | 5/2013 |
| EP | 2586886 | A1 | 5/2013 |
| EP | 2594656 | A1 | 5/2013 |
| EP | 2692894 | A1 | 2/2014 |
| EP | 2735623 | A1 | 5/2014 |
| EP | 2759613 | A1 | 7/2014 |
| EP | 2762581 | A1 | 8/2014 |
| EP | 2799562 | A1 | 11/2014 |
| EP | 2799578 | A1 | 11/2014 |
| EP | 2808413 | | 12/2014 |
| EP | 2843075 | A1 | 3/2015 |
| EP | 2868762 | A1 | 5/2015 |
| EP | 2868764 | A1 | 5/2015 |
| JP | S 58-91121 | A | 5/1983 |
| JP | 58-136719 | A | 8/1983 |
| JP | 59067365 | | 4/1984 |
| JP | S 63-166931 | A | 7/1988 |
| JP | 028349 | A | 7/1993 |
| JP | 05171347 | | 7/1993 |
| JP | 05271865 | A | 10/1993 |
| JP | H 08-26433 | B2 | 3/1996 |
| JP | 09025513 | A | 1/1997 |
| JP | 09025543 | A | 1/1997 |
| JP | 09143570 | A | 6/1997 |
| JP | 09209076 | A | 8/1997 |
| JP | 09279296 | A | 10/1997 |
| JP | 10265846 | A | 10/1998 |
| JP | 10306343 | A | 11/1998 |
| JP | 1140542 | A | 5/1999 |
| JP | 2000199034 | A | 7/2000 |
| JP | 2000212687 | A | 8/2000 |
| JP | 2901316759 | A | 11/2001 |
| JP | 2002069572 | A | 3/2002 |
| JP | 2002105595 | A | 4/2002 |
| JP | 2003089848 | A | 3/2003 |
| JP | 2003105489 | A | 4/2003 |
| JP | 2003138343 | A | 5/2003 |
| JP | 2003160836 | A | 6/2003 |
| JP | 2003-221648 | A | 8/2003 |
| JP | 2003221648 | A | 8/2003 |
| JP | 2003-268509 | A | 9/2003 |
| JP | 2003277887 | A | 10/2003 |
| JP | 2003328071 | A | 11/2003 |
| JP | 2004-143518 | A | 5/2004 |
| JP | 2004143518 | A | 5/2004 |
| JP | 2004256831 | A | 9/2004 |
| JP | 3591502 | B2 | 11/2004 |
| JP | 2005002406 | A | 1/2005 |
| JP | 20135120437 | A | 5/2005 |
| JP | 2005171331 | A | 6/2005 |
| JP | 2005264205 | A | 9/2005 |
| JP | 2005307339 | A | 11/2005 |
| JP | 2006124789 | A | 5/2006 |
| JP | 2006161111 | A | 6/2006 |
| JP | 2006161112 | A | 6/2006 |
| JP | 2006-213957 | A | 8/2006 |
| JP | 3821036 | A | 9/2006 |
| JP | 2007031771 | A | 2/2007 |
| JP | 2007063668 | A | 3/2007 |
| JP | 2007070662 | A | 3/2007 |
| JP | 2007247046 | A | 9/2007 |
| JP | 2007262487 | A | 10/2007 |
| JP | 2007270197 | A | 10/2007 |
| JP | 2007277661 | A | 10/2007 |
| JP | 2007302992 | A | 11/2007 |
| JP | 2008156680 | A | 7/2008 |
| JP | 2008174776 | A | 7/2008 |
| JP | 2008179852 | A | 8/2008 |
| JP | 4154936 | B2 | 9/2008 |
| JP | 2008274416 | A | 11/2008 |

(56) References Cited

FOREIGN PATENT DOCUMENTS

| | | | |
|---|---|---|---|
| JP | 2008280598 | A | 11/2008 |
| JP | 2009-52139 | A | 3/2009 |
| JP | 2009052139 | A | 3/2009 |
| JP | 2009068067 | A | 4/2009 |
| JP | 2009084637 | A | 4/2009 |
| JP | 2009084643 | A | 4/2009 |
| JP | 4-273768 | B2 | 6/2009 |
| JP | 2009275238 | A | 11/2009 |
| JP | 2011026690 | A | 2/2011 |
| JP | 2011-225980 | A | 11/2011 |
| JP | 2011225978 | A | 11/2011 |
| JP | 2012001775 | A | 1/2012 |
| JP | 2012026032 | | 2/2012 |
| JP | 2012026034 | A | 2/2012 |
| JP | 2012036497 | A | 2/2012 |
| JP | 2012112039 | A | 6/2012 |
| JP | 2012172257 | A | 9/2012 |
| JP | 2012177167 | A | 9/2012 |
| JP | 2012177176 | A | 9/2012 |
| JP | 2012251200 | A | 12/2012 |
| JP | 2012251201 | A | 12/2012 |
| JP | 2013019048 | A | 1/2013 |
| JP | 2013053330 | A | 3/2013 |
| KR | 20100029138 | A | 3/2010 |
| KR | 100962745 | B1 | 6/2010 |
| KR | 20100087239 | A | 8/2010 |
| KR | 20120128721 | A | 11/2012 |
| TW | 550298 | B | 9/2003 |
| WO | 2008078917 | A1 | 7/2008 |
| WO | 2008123366 | A1 | 10/2008 |
| WO | 2010131303 | A1 | 11/2010 |
| WO | 2011122031 | | 10/2011 |
| WO | 2011122031 | A | 10/2011 |
| WO | 2011132763 | A1 | 10/2011 |
| WO | 2011162412 | | 12/2011 |
| WO | 2011162418 | A1 | 12/2011 |
| WO | 2012128228 | A | 9/2012 |
| WO | 2012133540 | A | 10/2012 |
| WO | 2012133636 | A1 | 10/2012 |
| WO | 2013011660 | A1 | 1/2013 |
| WO | 2013047755 | A1 | 4/2013 |
| WO | 2013099206 | A1 | 7/2013 |

OTHER PUBLICATIONS

Chinese Office Action for Chinese Application No. 201280074343.1, dated Aug. 23, 2016, with Concise Statement of Relevance—12 pages 2018.
Chinese Office Action for Chinese Application No. 2014800037031.8, dated Jul. 4, 2017, including Concise Statement of Search Report—8 pages 2018.
Chinese Office Action for Chinese Application No. 201480006995.0, dated Jun. 27, 2017, including Concise Statement of Search Report—7 pages 2018.
Chinese Office Action for Chinese Application No. 201280074343.1, dated Mar. 14, 2017, including Concise Statement of Search Report—8 pages 2018.
Chinese Office Action for Chinese Application No. 201480006995.0, dated May 18, 2016, including Concise Statement of Search Report—20 pages 2018.
Chinese Office Action for Chinese Application No. 201480007031.8, dated May 27, 2016, including Concise Statement of Search Report—22 pages 2018.
Chinese Office Action for Chinese Application No. 201280074343.1, dated Nov. 6, 2017, including Concise Statement of Search Report—6 pages 2018.
Extended European Search Report for European Application No. 12879635.6, dated Feb. 8, 2016—9 pages 2018.
Extended European Search Report for European Application No. 14745697.4, dated Jan. 26, 2016—7 pages 2018.
Extended European Search Report for European Application No. 14746847,4, dated Jan. 26, 2016—6 pages 2018.
Extended European Search Report for European Application No. 14746693.2, dated Jan. 27, 2016—7 pages 2018.
Final Office Action for U.S. Appl. No. 14/781,440, dated Apr. 24, 2018—14 pages 2018.
Final Office Action for U.S. Appl. No. 14/764,818, dated Jul. 14, 2017—8 pages 2018.
Final Office Action for U.S. Appl. No. 14/764,637, dated Oct. 4, 2017—13 pages 2018.
Final Office Action for U.S. Appl. No. 14/764,625, dated Sep. 25, 2017—14 pages 2018.
International Search Report for International Application No. PCT/JP2014/000335, dated Apr. 28, 2014—2 pages 2018.
International Search Report for International Application No. PCT/JP2014/000336, dated May 13, 2014—2 pages 2018.
International Search Report for International Application No. PCT/JP2014/000337 dated May 13, 2014—2 pages 2018.
International Search Report and Written Opinion for International Application No. PCT/JP2011/0001931, dated Jun. 28, 2011—5 pages 2018.
International Search Report and Written Opinion for International Application No. PCT/JP2012/067025, dated Sep. 4, 2012—6 pages 2018.
Kang, Y., "Quality Control and Formability of Modern Automobile Board", Metallurgical Industry Press, Aug. 1999—p. 30 (Abstract only) 2018.
Korean Notice of Allowance for Korean Application No. 10-2015-7019345, dated Jun. 15, 2017—1 page 2018.
Korean Notice of Allowance for Korean Application No. 10-2015-7019347, dated Jun. 15, 2017—1 page 2018.
Korean Office Action for Korean Application No. 10-2015-7019346, dated Apr. 24, 2017 with partial English translation—5 pages 2018.
Korean Office Action for Korean Application No. 10-2015-7019346, dated Aug. 23, 2017—6 pages 2018.
Korean Office Action for Korean Application No. 10-2015-7019345, dated Feb. 27, 2017—6 pages 2018.
Korean Office Action for Korean Application No. 2015-7000899, dated Mar. 29, 2016—6 pages 2018.
Korean Office Action for Korean Application No. 10-2015-7019346, dated Sep. 8, 2016—7 pages 2018.
Li, J., "Reinforcement Basis and Construction Technology", China Construction Industry Press, Mar. 2012—p. 45 (Abstract only) 2018.
Li, M., "Technical Manual of Controlled Rolling and Controlled Cooling of Steel", Metallurgical Industry Press, Sep. 1990—4 pages 2018.
Non Final Office Action for U.S. Appl. No. 14/764,637, dated Feb. 15, 2017—12 pages 2018.
Non Final Office Action for U.S. Appl. No. 14/764,625, dated Mar. 16, 2018—15 pages 2018.
Non Final Office Action for U.S. Appl. No. 14/764.637, dated May 1, 2018—18 pages 2018.
Non Final Office Action for U.S. Appl. No. 14/781,440, dated Oct. 18, 2017—18 pages 2018.
Wang, Z., "Engineering Materials", China Machine Press. Feb. 2012—11 pages (Abstract only) 2018.
Wang, D., "Production Technology of Converter Steelmaking", Chemical Construction Industry, Jan. 2008—p. 313 2018.
Wong, Q., "Ultra-Fine Grained Steels-Microstructure Refinement Theory and Control Technology of Steel", Metallurgical Industry Press, Sep. 2003—p. 385 2018.
Yang, H., "Design Principle of Rolling Mill", Metallurgical Industry Press, Jan. 2011—p. 230 (Abstract only) 2018.
Non Final Office Action for U.S. Appl. No. 14/409,549, dated Mar. 3, 2017. 15 pages. 2017.
Final Office Action for U.S. Appl. No. 14/409,549, dated Jul. 6, 2017, 8 pages. 2017.
Non Final Office Action for U.S. Appl. No. 14/409,549, dated Oct. 23, 2017, 9 pages. 2017.
Non Final Office Action for U.S. Appl. No. 14/408,662, dated Apr. 12, 2017, 14 pages. 2017.
Non Final Office Action for U.S. Appl. No. 14/365,392, dated Apr. 26, 2016, 13 pages 2016.

(56) References Cited

OTHER PUBLICATIONS

European Communication for European Application No. 13744071.
5, dated Mar. 13, 2019, 5 pages.

* cited by examiner

HOT-ROLLED STEEL SHEET FOR GENERATOR RIM AND METHOD FOR MANUFACTURING THE SAME

CROSS REFERENCE TO RELATED APPLICATIONS

This is the U.S. National Phase application of PCT/JP2013/051956, filed Jan. 30, 2013, which claims priority to Japanese Patent Application No. 2012-018306, filed Jan. 31, 2012, the disclosures of each of these applications being incorporated herein by reference in their entireties for all purposes.

FIELD OF THE INVENTION

The present invention relates to a hot-rolled steel sheet having a yield strength YS of 700 MPa or more and a method for manufacturing the same and, in particular, to a hot-rolled steel sheet excellent in magnetic properties suitable for a generator rim for use in hydraulic power generation or the like and a method for manufacturing the same.

BACKGROUND OF THE INVENTION

From the viewpoint of the preservation of the global environment, global warming has been recently regarded as a problem, and it has been desired to reduce carbon dioxide $CO_2$ emissions by such methods as improving the fuel efficiency of automobiles. From such a viewpoint of curbing global warming, hydraulic power generators have been recently reconsidered as a clean energy source. A generator such as the hydraulic power generator includes a rotor and a stator, in which the rotor includes a pole core serving as an iron core and a rim that supports it. In order to gain generating capacity, the rotor is required to be rotated at a high speed. For this purpose, the rim is required to hold high strength in order to resist a centrifugal force caused by the high-speed rotation, and hot-rolled steel sheets having a yield strength of about 550 MPa have been mainly used for the rim. However, it has been recently demanded to use high-strength hot-rolled steel sheets having a yield strength of about 700 MPa or more. The steel sheets for the rim are required to hold excellent magnetic properties at the same time.

In response to such a demand, Patent Literature 1, for example, discloses a hot-rolled steel sheet containing, in terms of percent by weight, C: 0.02% or more and 0.10% or less, Si: 2.0% or less, Mn: 0.5% or more and 2.0% or less, P: 0.08% or less, S: 0.006% or less, N: 0.005% or less, and Al: 0.01% or more and 0.1% or less, contains Ti in an amount of Ti: 0.06% or more and 0.3% or less and $0.50<(Ti-3.43N-1.5S)/4C$, and having a microstructure that has an areal ratio of low-temperature transformed products and pearlite of 15% or less, and in which TiC is dispersed in polygonal ferrite. With the technique disclosed in Patent Literature 1, one or more of Nb, Mo, V, Zr, Cr, Ni, Ca, or other elements may be contained in the hot-rolled steel sheet. Although not considering magnetic properties, the technique disclosed in Patent Literature 1 can achieve a hot-rolled steel sheet having remarkably improved stretch flange formability at high strength with a tensile strength TS of 70 kgf/mm$^2$ (690 MPa). However, the technique disclosed in Patent Literature 1 requires a large content of Ti in order to ensure the desired high strength. This makes coarse Ti carbide exceeding 30 nm, which does not contribute to higher strength, likely to be produced. The amount of solute Ti increases. Bainitic ferrite having high dislocation density is likely to be produced, and magnetic properties can degrade accordingly.

Patent Literature 2 discloses a method for manufacturing a high-tensile hot-rolled steel sheet having high magnetic flux density. The technique disclosed in Patent Literature 2 is a method for manufacturing a high-tensile hot-rolled steel sheet including heating a steel slab containing, in terms of percent by weight, C: 0.05% or more and 0.15% or less, Si: 0.50% or less, Mn: 0.70% or more and 2.00% or less, P: 0.020% or less, S: 0.010% or less, sol. Al: 0.010% or more and 0.10% or less, N: 0.0050% or less, Ti: 0.10% or more and 0.30% or less, and B: 0.0015% or more and 0.005% or less to a temperature of 1200° C. or more, performing hot rolling with a hot-rolling finishing temperature within the range of the Ar3 transformation point or more and 950° C. or less, cooling it with a cooling rate within the range of 30° C./s or more and less than 70° C./s, and winding it at 500° C. or less. The technique disclosed in Patent Literature 2 can achieve a high-tensile strength hot-rolled steel sheet having high magnetic flux density with a magnetic flux density $B_{100}$ of 1.77 T or more with an yield strength YS of 80 kg/mm$^2$ (785 MPa) or more and a tensile strength TS of 100 kg/mm$^2$ (980 MPa) or more. However, the technique disclosed in Patent Literature 2 essentially contains B for the purpose of improving hardenability and performs quenching after hot rolling. This makes a bainite phase likely to be produced, and magnetic properties degrade, leading to insufficient magnetic properties as an iron core of a rotary machine.

Patent Literature 3 discloses a method for manufacturing a high-tensile strength hot-rolled steel sheet having high magnetic flux density. The technique disclosed in Patent Literature 3 is a method for manufacturing a high-tensile strength hot-rolled steel sheet including heating a steel slab containing, in terms of percent by weight, C: 0.02% or more and 0.06% or less, Si: 0.10% or less, Mn: 0.3% or more and 1.2% or less, S: 0.02% or less, Al: 0.10% or less, N: 0.01% or less, and Ti: 0.05% or more and 0.30% or less to a temperature of 1200° C. or more, performing hot rolling with a hot-rolling finishing temperature within the range of the Ar3 transformation point or more and 900° C. or less, and winding it in the temperature range of 500° C. or more and 650° C. or less. The technique disclosed in Patent Literature 3 can achieve a high-tensile strength hot-rolled steel sheet having a tensile strength TS of 50 kg/mm$^2$ (490 MPa) and a magnetic flux density $B_{100}$ of 1.8 T or more. The technique disclosed in Patent Literature 3 reduces the content of Si to 0.10% or less and ensures desired high strength through precipitation strengthening by Ti carbide. However, the technique disclosed in Patent Literature 3 contains a large amount of Ti, which makes bainitic ferrite having high dislocation density likely to be produced, degrades magnetic properties, and makes it difficult to ensure sufficient magnetic properties as an iron core of a rotary machine.

Patent Literature 4 discloses a hot-rolled steel sheet for an iron core of a rotary machine that contains, in terms of percent by weight, C: 0.10% or less, Si: 0.5% or less, Mn: 0.2% or more and 2% or less, P: 0.06% or less, S: 0.01% or less, Al: 0.1% or less, N: 0.006% or less, and Ti: 0.02% or more and 0.2% or less, further contains at least one of Mo: 0.7% or less (except for the range of 0.2% or less) and W: 0.15% or less, contains carbide smaller than 10 nm containing at least one of Ti, Mo, and W dispersed in a ferrite structure with a volume fraction of 95% or more, and has a strength of about 590 MPa or more. The technique disclosed in Patent Literature 4 can achieve a high-strength hot-rolled steel sheet that has excellent magnetic properties while having excellent formability and has sufficient properties as an iron core of a rotary machine.

PATENT LITERATURE

Patent Literature 1: Japanese Examined Patent Application Publication No. 08-26433

Patent Literature 2: Japanese Laid-open Patent Publication No. 63-166931

Patent Literature 3: Japanese Laid-open Patent Publication No. 58-91121

Patent Literature 4: Japanese Patent No. 4273768

SUMMARY OF THE INVENTION

Although the technique disclosed in Patent Literature 4 can achieve a hot-rolled steel sheet having excellent magnetic properties, it requires large contents of expensive Mo and W, increasing material costs.

The present invention has been achieved in view of the above problem, and objects thereof are to provide a hot-rolled steel sheet for a generator rim having both high strength with a yield strength YS in a rolling direction of 700 MPa or more and excellent magnetic properties with a magnetic flux density $B_{50}$ of 1.5 T or more and a magnetic flux density $B_{100}$ of 1.6 T or more without a large content of expensive alloy elements with a relatively inexpensive component range and a method for manufacturing the same.

The magnetic flux densities $B_{50}$ and $B_{100}$ are indicators indicating DC magnetic properties and indicate magnetic flux densities B (T) at a magnetizing force H=5,000 A/m and 10,000 A/m, respectively. The higher value means having more excellent magnetic properties.

A hot-rolled steel sheet for a generator rim according to an embodiment of the present invention has a structure comprising a ferrite phase having an areal ratio of 95% or more in which precipitates containing Ti and V whose average grain diameter is less than 10 nm are precipitated in crystal grains of the ferrite phase, wherein the ferrite phase has an average crystal grain diameter within a range of 2 μm or more and less than 10 μm, and the hot-rolled steel sheet has strength with a yield strength YS in a rolling direction of 700 MPa or more and electromagnetic properties with a magnetic flux density $B_{50}$ of 1.5 T or more and a magnetic flux density $B_{100}$ of 1.6 T or more.

In the above-described hot-rolled steel sheet for a generator rim according to an embodiment of the present invention, the structure includes a ferrite phase with an areal ratio of 95% or more in which precipitates further containing one or two of Nb and Mo in addition to Ti and V whose average grain diameter is less than 10 nm are precipitated in crystal grains of the ferrite phase.

The above-described hot-rolled steel sheet for a generator rim according to an embodiment of the present invention further has, in addition to the structure, a composition including: in terms of percent by mass, C: 0.03% or more and 0.11% or less, Si: 0.3% or less, Mn: 1.0% or more and 2.0% or less, P: 0.06% or less, S: 0.01% or less, Al: 0.06% or less, N: 0.006% or less, Ti: 0.06% or more and 0.21% or less, and V: 0.05% or more and 0.20% or less; solute V with a content of 0.005% or more; and the balance of Fe and inevitable impurities.

The above-described hot-rolled steel sheet for a generator rim according to an embodiment of the present invention further has, in addition to the structure, a composition including: in terms of percent by mass, C: 0.03% or more and 0.11% or less, Si: 0.3% or less, Mn: 1.0% or more and 2.0% or less, P: 0.06% or less, S: 0.01% or less, Al: 0.06% or less, N: 0.006% or less, Ti: 0.06% or more and 0.21% or less, and V: 0.05% or more and 0.20% or less; solute V with a content of 0.005% or more; one or two selected from Nb: 0.08% or less and Mo: 0.2% or less; and the balance of Fe and inevitable impurities.

A method for manufacturing a hot-rolled steel sheet for a generator rim according to an embodiment of the present invention includes: melting molten steel having a composition comprising, in terms of percent by mass, C: 0.03% or more and 0.11% or less, Si: 0.3% or less, Mn: 1.0% or more and 2.0% or less, P: 0.06% or less, S: 0.01% or less, Al: 0.06% or less, N: 0.006% or less, Ti: 0.06% or more and 0.21% or less, V: 0.05% or more and 0.20% or less, and the balance of Fe and inevitable impurities; making the molten steel into a steel material by continuous casting or ingot making; heating the steel material to a temperature of 1,100° C. or more immediately or after once cooling the steel material; subjecting the steel material to hot rolling with a steel sheet temperature on the exit side of a hot rolling mill of 800° C. or more; after the hot rolling, cooling the steel sheet with a cooling rate of 30° C./s or more until the steel sheet temperature reaches down to 700° C.; and winding the steel sheet with a winding temperature within a range of 500° C. or more and 700° C. or less.

In the above-described method for manufacturing a hot-rolled steel sheet for a generator rim according to an embodiment of the present invention, the composition further comprises, in terms of percent by mass, one or two selected from Nb: 0.08% or less and Mo: 0.2% or less.

The present invention can provide a hot-rolled steel sheet for a generator rim that has both high strength with a yield strength YS in a rolling direction of 700 MPa or more and excellent magnetic properties with a magnetic flux density $B_{50}$ of 1.5 T or more and a magnetic flux density $B_{100}$ of 1.6 T or more without a large content of expensive alloy elements with a relatively inexpensive component range and a method for manufacturing the same.

DETAILED DESCRIPTION OF EMBODIMENTS OF THE INVENTION

The inventors of the present invention have earnestly studied various factors exerting influence on magnetic properties while maintaining high strength with a yield strength in the rolling direction of 700 MPa or more. The inventors have thought of utilizing V without using expensive Mo and W to develop a composition that contains an appropriate amount of V as well as Ti. The inventors have newly found out that optimization of a cooling rate and a winding temperature after the finish rolling of hot rolling achieves a structure that is a single phase containing a ferrite phase having an average crystal grain diameter within a range of 2 μm or more and less than 10 μm in which extremely fine precipitates (carbides, nitrides, and carbonitrides) with an average grain diameter of 10 nm or less are dispersed in crystal grains of the ferrite phase and remarkably improves magnetic properties while maintaining high strength with a yield strength of 700 MPa or more by containing solute V in an amount of 0.005% or more.

Although the mechanism that remarkably improves magnetic properties while maintaining high strength with a yield strength of 700 MPa or more has been so far unclear, the inventors think as follows. In general, when a steel sheet structure does not inhibit magnetic walls from moving, such a structure can have high magnetic flux density, improving magnetic properties. The structure of the steel sheet according to an embodiment of the present invention is a single phase containing a ferrite phase that has low dislocation density and excellent magnetic properties and does not contain any martensite phase and bainite phase, which have high dislocation density that inhibits the movement of the magnetic walls. In addition, the extremely fine precipitates with an average grain diameter of 10 nm or less are precipitated in the crystal grains of the ferrite phase. It is understood that such extremely fine precipitates largely contribute to an increase in strength, but they do not inhibit the movement of the magnetic walls, and hence high magnetic flux density is achieved while maintaining high strength. Furthermore, it is understood that strain around the fine precipitates is relaxed by solid-solving an appropriate amount of V, which is close to Fe in atomic radius, contributing to high magnetic flux density.

The following describes embodiments of the present invention specifically.

The hot-rolled steel sheet according to an embodiment of the present invention has a structure containing a single phase containing a ferrite phase in which precipitates containing Ti and V whose average grain diameter is less than 10 nm and further optionally one or two of Nb and Mo are precipitated in crystal grains of the ferrite phase. The "single phase containing a ferrite phase" is not limited to the ferrite phase having an areal ratio of 100% and includes a substantially single phase in which the ferrite phase has an areal ratio of 95% or more and more preferably 98% or more.

Formability can be remarkably improved by the structure of the "single phase containing a ferrite phase" that is the most effective in improving formability. Magnetic properties can also be remarkably improved by the "single phase containing a ferrite phase" that does not contain any martensite phase and bainite phase. The crystal grains of the ferrite phase are made finer to have an average crystal grain diameter of 2 μm or more and less than 10 μm, and the precipitates containing Ti and V precipitated in the ferrite crystal grains are made to have an average grain diameter of 10 nm or less, thereby achieving high strength with a yield strength YS of 700 MPa or more. However, finer crystal grains with an average crystal grain diameter of less than 2 μm inhibit the movement of the magnetic walls, which is not likely to provide remarkable improvement in magnetic properties.

The precipitates containing Ti and V with an average grain diameter of less than 10 nm precipitated in the ferrite crystal grains have an effect of strengthening steel sheets without degrading magnetic properties. When the average grain diameter of the precipitates containing Ti and V is coarsened to be 10 nm or more, high strength with a yield strength YS of 700 MPa cannot be ensured. In order to ensure the desired high strength when the average grain diameter of the precipitated precipitates is 10 nm or more, the amount of precipitation of the precipitates is required to be increased. In order to precipitate a larger amount of the precipitates, the content of precipitate-forming elements inevitably increases, leading to an increase in material costs.

In view of the above circumstances, the average grain diameter of the precipitates whose metallic elements contained are Ti and V is preferably less than 10 nm. In order to reduce the content of the precipitate-forming elements and ensure the desired high strength, it is desirable to make the average grain diameter of the precipitates whose metallic elements contained are Ti and V smaller; it is more preferably 8 nm or less and more preferably 5 nm or less. Although the precipitates are most preferably carbide, nitride and carbonitride do not exert any influence on the essence of the invention so long as the average grain diameter preferably less than 10 nm.

The precipitates whose metallic elements contained are Ti and V may further contain one or more of Nb and Mo in a composite manner. Specifically, no influence is exerted on the essence of the invention by carbides, nitrides, and carbonitrides of Ti, carbides, nitrides, and carbonitrides of Nb, carbides, nitrides, and carbonitrides of V, and carbides, nitrides, and carbonitrides of Mo that are precipitated singly and/or in a composite manner.

It is preferable that the hot-rolled steel sheet according to the present invention having the above structure have a composition that contains, in terms of percent by mass, C: 0.03% or more and 0.11% or less, Si: 0.3% or less, Mn: 1.0% or more and 2.0% or less, P: 0.06% or less, S: 0.01% or less, Al: 0.06% or less, N: 0.006% or less, Ti: 0.06% or more and 0.21% or less, and V: 0.05% or more and 0.20% or less, has a content of solute V of 0.005% or more, optionally contains one or two selected from Nb: 0.08% or less and Mo: 0.2% or less, and the balance of Fe and inevitable impurities.

Described next are reasons for selecting the preferable components of the hot-rolled steel sheet according to the present invention. Percent by mass for the components are simply denoted by % below.

C Content

C is an element that bonds to a carbide-forming element and contributes to ensuring the desired strength through precipitation strengthening by the formation of fine carbide. In order to achieve such an effect, a content of 0.03% or more is required. A content of less than 0.03% has an insufficient effect. When the content exceeds 0.11%, pearlite having coarse carbide is formed, which does not contribute to steel strengthening, decreasing magnetic properties. For this reason, the C content is preferably limited to the range of 0.03% or more and 0.11% or less. The C content is more preferably 0.04% or more and 0.10% or less.

Si Content

Si is an element that effectively increases the strength of steel sheets through solid solution strengthening. When the content thereof exceeds 0.3%, C is promoted to be discharged from the ferrite, and coarse iron carbide is likely to be precipitated in grain boundaries, which brings about not only deterioration in magnetic properties. Deterioration in the surface property of steel sheets also occurs. In view of this, the Si content is preferably limited to 0.3% or less. The Si content is more preferably 0.1% or less. The Si content may be zero, which causes no problems.

Mn Content

Mn is an element effective for making carbide precipitated in the crystal grains of the ferrite phase finer and increasing the strength of steel sheets. Most of the carbides precipitated in the crystal grains of the ferrite phase are carbides precipitated simultaneously with an austenite (γ)-to-ferrite (α) transformation during a cooling process after the termination of finish rolling in a hot-rolled steel sheet manufacturing process. For this reason, when the γ-to-α transformation temperature of steel is high, carbide is precipitated in a high-temperature range, and the carbide is coarsened in the cooling process before winding. In addressing such a problem, because Mn has an effect of lowering the γ-to-α transformation temperature of steel, a certain amount of Mn contained reduces the γ-to-α transformation temperature of steel to a winding temperature range described below, thereby enabling the carbide to be precipitated while the steel sheet is being wound, Such carbide precipitated during winding without being exposed to the high-temperature range for a long time is maintained at a fine state. In order to make the carbide finer and achieve a hot-rolled steel sheet with a yield strength YS of 700 MPa or more, Mn is preferably contained in an amount of 1.0% or more. When the Mn content exceeds 2.0%, segregation is remarkable, and the transformation temperature is so low that a hard second phase such as bainite and martensite is formed, degrading magnetic properties. For this reason, the Mn content is preferably within the range of 1.0% or more and 2.0% or less. The Mn content is more preferably within the range of more than 1.3% and 1.5% or less.

P Content

P is an element that is solid-solved to effectively contribute to increase the strength of steel sheets. However, P has a strong tendency to segregate in sites such as grain boundaries, and when the content thereof exceeds 0.06%, toughness and magnetic properties remarkably degrade. For this reason the P content is preferably limited to 0.06% or less. The P content is more preferably 0.03% or less. The P content may be zero, which causes no problems.

S Content

S is present in steel as an inclusion and degrades ductility, toughness, or other properties. For this reason, although in the present invention the S content is preferably reduced to a minimum, a content up to 0.01% is allowable from the viewpoint of magnetic properties. In view of these circumstances, the S content is preferably limited to 0.01% or less. The S content is more preferably 0.005% or less. The S content may be zero, which causes no problems.

Al Content

Al acts as a deoxidizer. In order to produce such an effect, Al is preferably contained in an amount of 0.01% or more. However, the content thereof exceeds 0.06%, oxide-based inclusions increase excessively, degrading formability. For this reason, the Al content is preferably limited to 0.06% or less. The Al content is more preferably 0.04% or less.

N Content

N is likely to bond to nitride-forming elements such as Ti and V to form coarse nitride such as TiN. The coarse nitride brings about deterioration in magnetic properties and reduces the amount of such elements as Ti and V, which originally form fine carbide and are effective in contributing to higher strength of steel sheets, making it difficult to ensure the desired high strength. For this reason, the N content is preferably limited to 0.006% or less. The N content is more preferably 0.004% or less. The N content may be zero, which causes no problems.

Ti Content

Ti is a beneficial element in the present invention that forms fine carbide, nitride, carbonitride, and the like and ensures the desired high strength through precipitation strengthening. In order to produce such an effect, Ti is preferably contained in an amount of 0.06% or more. When the Ti content exceeds 0.21%, only coarse carbide and nitride, which do not contribute to the strengthening of steel, increase, and useless inclusions that do not contribute to strengthening increase, which is not likely to produce an effect commensurate with the content. For this reason, the Ti content is preferably within the range of 0.06% or more and 0.21% or less. The Ti content is more preferably within the range of 0.08% or more and 0.15% or less.

V Content

V is, in like manner with Ti, a beneficial element in the present invention that forms fine carbide, nitride, carbonitride, and the like and ensures the desired high strength through precipitation strengthening. In order to produce such an effect, V is preferably contained in an amount of 0.05% or more. When the V content exceeds 0.20%, only coarse carbide and nitride, which do not contribute to the strengthening of steel, increase, and useless inclusions that do not contribute to strengthening increase, which is not likely to produce an effect commensurate with the content. For this reason, the V content is preferably within the range of 0.05% or more and 0.20% or less. The V content is more preferably within the range of 0.08% or more and 0.15% or less.

Solute V Content

Solute V has effect that relaxes strain around precipitates to contribute to improvement in magnetic properties. In order to produce such an effect, solute V is preferably contained in an amount of 0.005% or more. Although the upper limit of the solute V content is not limited, it is less than the V content because of the inevitable precipitation of V.

In addition to the above components, one or two selected from Nb: 0.08% or less and Mo: 0.20% or less may be contained as optional elements. Both Nb and Mo are elements that form fine carbide, nitride, carbonitride, and the like and contribute to higher strength through precipitation strengthening; they can be selected and contained as needed.

Nb Content

Nb is an element that forms fine carbide, nitride, carbonitride, and the like and ensures the desired high strength through precipitation strengthening. In order to produce such an effect, Nb is preferably contained in an amount of 0.01% or more. When the Nb content exceeds 0.08%, excessive precipitates are produced, degrading magnetic properties. For this reason, when Nb is contained, the Nb content is preferably limited to 0.08% or less. The Nb content is preferably within the range of 0.03% or more and 0.07% or less.

Mo Content

Mo is, in like manner with Nb, an element that is solid-solved in fine carbide, nitride, carbonitride, and the like containing Ti and V and has an effect of ensuring the desired high strength. Mo is also an element that inhibits pearlite transformation and promotes the formation of a ferrite single phase structure. In order to produce such an effect, Mo is preferably contained in an amount of 0.05% or more. When the Mo content exceeds 0.20%, a hard phase may be formed, degrading magnetic properties and increasing manufacturing costs. For this reason, when Mo is contained, the Mo content is preferably limited to 0.20% or less. The Mo content is preferably within the range of 0.05% or more and 0.15% or less.

The balance other than the above components is made up of Fe and inevitable impurities. The inevitable impurities allowed to be contained may include O: 0.01% or less, Cu: 0.5% or less, Ni: 0.5% or less, Cr: 0.5% or less, Sn: 0.3% or less, Ta: 0.1% or less, W: 0.1% or less, Ca: 0.005% or less, Mg: 0.005% or less, REM: 0.005% or less and B: 0.005% or less.

Method for Manufacturing Hot-Rolled Steel Sheet

Described next is a preferable method for manufacturing a hot-rolled steel sheet according to the present invention.

In manufacturing the hot-rolled steel sheet according to the present invention, it is preferable to subject a steel material having the above composition to hot rolling immediately or hot rolling after once cooling and heating to form a hot-rolled steel sheet. The method for forming the steel material preferably includes, but not limited to, melting molten steel having the above composition by normal means for melting such as converters and electric furnaces and forming the steel material such as a slab by a normal casting method such as continuous casting.

When the obtained steel material maintains a temperature that allows hot rolling, the steel material is subjected to hot rolling immediately or after once being cooled to near room temperature and then heated to a temperature of 1,100° C. or more, preferably 1,250° C. or more. The heating before hot rolling is beneficial to solid-solve coarse precipitates that adversely affect magnetic properties, and after hot rolling, to finely precipitate precipitates containing Ti and V (preferably carbide) or precipitates containing Ti and V and further one or two of Nb and Mo (preferably carbide); it is preferred to perfectly solid-solve Ti, Nb, V, and Mo before subjecting the steel material to hot rolling. Thus, the steel material (slab) is subjected to hot rolling immediately or is once cooled and is then heated to a temperature of 1,100° C. or more, preferably 1,250° C. or more.

For the steel material (slab) that is not cooled to a low temperature after casting, Ti, Nb, V, and Mo are solid-solved, and because the solid solution state is maintained when hot rolling is immediately performed, the steel material is not required to be heated before hot rolling. When the steel material is once cooled to a lower temperature such as room temperature, however, coarse precipitates are formed. In view of this, the steel material cooled to a lower temperature is required to be heated to a temperature of 1,100° C. or more, preferably 1,250° C. or more, thereby solid-solving Ti, Nb, V, and Mo again. After casting, heating intended for concurrent heating followed by immediate hot rolling does not cause any problem and does not exert any influence on the effect of the present invention.

The steel material heated to the above temperature is subjected to hot rolling. The hot rolling is rolling including rough rolling and finish rolling. The rough rolling, regardless of its conditions, only requires forming sheet bars (rough-rolled bars) having certain dimensions and shapes. Even when heating the sheet bars or maintaining the heat of the sheet bars after the rough rolling and before the finish rolling or during the finish rolling, even when bonding the sheet bars after the rough rolling and performing continuous rolling, or even when simultaneously performing the heating of the sheet bars and continuous rolling, no problem is caused, and no influence is exerted on the effect of the present invention.

The finish rolling is rolling in which the steel sheet temperature on the exit side of a finish rolling mill is 800° C. or more. When the steel sheet temperature on the exit side of the finish rolling mill is less than 800° C., the desired yield strength in the rolling direction cannot be ensured, and the tensile strength falls short of desired tensile strength. In addition, the structure is made finer, making it difficult to ensure the desired magnetic properties. For this reason, the steel sheet temperature on the exit side of the finish rolling mill is limited to 800° C. or more. The steel sheet temperature on the exit side of the finish rolling mill is preferably within the range of 850° C. or more and 950° C. or less.

After the finish rolling completes, the steel sheet is cooled with an average cooling rate of 30° C./s or more until the steel sheet temperature reaches down to 700° C., thereafter the steel sheet is cooled to a winding temperature, and is then wound in a coil form. When the steel sheet is cooled with an average cooling rate of less than 30° C./s, precipitates are precipitated and then coarsened during cooling, which makes it unable not only to ensure the desired high strength but also to ensure the desired amount of solute V. For this reason, the cooling after the termination of the finish rolling is limited to a cooling rate with an average cooling rate of 30° C./s or more. The average cooling rate is preferably 50° C./s or more. However, because there is a danger that the steel sheet may degrade in shape when the average cooling rate exceeds 400° C./s or more, the average cooling rate is preferably less than 400° C./s.

The winding temperature is within the range of 500° C. or more and 700° C. or less. When the winding temperature is less than 500° C., a bainite phase and a martensite phase are contained, which makes it unable to ensure the desired ferrite single phase structure. In addition, the precipitates containing Ti and V and further containing Nb and Mo are not sufficiently precipitated, which makes it unable to ensure the desired high strength. When the winding temperature is a higher temperature exceeding 700° C., the precipitates are coarsened, which weakens precipitation strengthening. Thus, the winding temperature is within the range of 500° C. or more and 700° C. or less. The winding temperature is preferably within the range of 550° C. or more and 650° C. or less. This further improves a balance between strength and magnetic properties.

The hot-rolled steel sheet does not vary in its property regardless of being in a scaled state or a state after being pickled. Temper rolling may further be performed so long as being within the range of conditions normally performed. The hot-rolled steel sheet according to the present invention is suitable to be used as electromagnetic members. The hot-rolled steel sheet according to the present invention is, for example, cut into a certain shape by means such as shearing, punching, and laser cutting, and then stacked to be used as electromagnetic members for rims and cores (such as pole cores). The hot-rolled steel sheet according to the present invention can be used in particular to generator rims that require both high strength and favorable magnetic properties. In stacking the steel sheets, the steel sheets to be stacked are preferably electrically isolated from each other by applying an insulating coating onto the steel sheets or interposing an insulating material between the steel sheets.

Examples

The present invention is further described with reference to examples.

Pieces of steel of component compositions listed in Table 1 were melted to form slabs (steel materials: a thickness of 250 mm) by continuous casting and were then subjected to hot rolling under the conditions listed in Table 2 to form hot-rolled steel sheets having the sheet thicknesses listed in Table 2. Test pieces were taken from the obtained hot-rolled steel sheets, and a structure observation test, analysis of the content of solute V, a tensile test, and a magnetic properties measuring test were performed thereon to examine strength and magnetic properties. The methods for testing were as follows.

(1) Structure Observation Test

Test pieces for structure observation were taken from the obtained hot-rolled steel sheets. A section in the rolling direction (L section) of each test piece was polished and corroded with a nital solution, and its structure was observed with an optical microscope (magnification: 400×) and a scanning electron microscope (SEM) (magnification: 1,000×), and was taken photographs. For the obtained photographs of the structure, the type of the structure and the structure fraction were examined by image analysis processing. For the obtained photographs of the structure, the average ferrite grain diameter was measured by a method for cutting in conformity with the ASTM standard, ASTM E 112-10, by image analysis processing. Thin films for observation with a transmission electron microscopy were taken from the obtained hot-rolled steel sheets, and the thin films were prepared by paper polishing and electrolytic polishing. The structure of each thin film was observed with a transmission electron microscope (TEM) (magnification: 135,000×). Thirty or more precipitates within the ferrite crystal grains were observed, and their average diameter was determined. Metallic elements contained in the precipitates were identified by an energy-dispersive X-ray spectrometer (EDX) attached to the TEM.

(2) Analysis of the Content of Solute V

Test pieces were taken from the obtained hot-rolled steel sheet and each were subjected to electrolytic extraction in a 10% acetylacetone (AA) solution. The electrolytic solution was extracted, and after removing the solvent, was solidified to measures the content.

(3) Tensile Test

A Japanese Industrial Standards (JIS) No. 5 test pieces (GL: 50 mm) were taken from the obtained hot-rolled steel sheets so that the tensile direction was parallel to the rolling direction. A tensile test was performed in conformity with the regulations of JIS standards JIS Z 2241 to determine tensile properties (yield strength YS and tensile strength TS).

(4) Magnetic Properties Measuring Test

Test pieces for magnetometry (size: 30×280 mm) were taken from the obtained hot-rolled steel sheets so that the rolling direction and the direction perpendicular to the rolling direction were the longitudinal direction of the test pieces. Magnetic flux density $B_{50}$ and magnetic flux density $B_{100}$ were measured using a DC magnetic properties measuring apparatus in conformity with the regulations of JIS standards JIS C 2555. The magnetic flux densities $B_{50}$ and $B_{100}$ are indicators indicating DC magnetic properties and indicate magnetic flux densities B (T) at a magnetizing force H=5,000 A/m and 10,000 A/m, respectively.

The obtained results are listed in Table 3.

TABLE 1

| | Chemical component (% by mass) | | | | | | | | | | |
|---|---|---|---|---|---|---|---|---|---|---|---|
| Steel No. | C | Si | Mn | P | S | Al | N | Ti | V | Mo, Nb | Remarks |
| A | 0.05 | 0.05 | 1.35 | 0.01 | 0.001 | 0.03 | 0.003 | 0.08 | 0.09 | — | Adaptable example |
| B | 0.07 | 0.05 | 1.46 | 0.01 | 0.005 | 0.06 | 0.005 | 0.11 | 0.12 | — | Adaptable example |
| C | 0.04 | 0.05 | 1.35 | 0.01 | 0.003 | 0.05 | 0.004 | 0.11 | 0.09 | Mo: 0.1, Nb: 0.05 | Adaptable example |
| D | 0.03 | 0.05 | 0.10 | 0.01 | 0.002 | 0.03 | 0.004 | 0.05 | 0.04 | — | Comparative example |
| E | 0.10 | 0.35 | 2.12 | 0.01 | 0.001 | 0.03 | 0.003 | 0.25 | 0.09 | — | Comparative example |
| F | 0.10 | 0.35 | 2.10 | 0.01 | 0.001 | 0.03 | 0.003 | 0.09 | 0.25 | — | Comparative example |
| G | 0.05 | 0.05 | 0.80 | 0.01 | 0.001 | 0.03 | 0.003 | 0.08 | 0.09 | — | Comparative example |

TABLE 2

| | | Hot rolling | | Cooling | | | | | |
|---|---|---|---|---|---|---|---|---|---|
| Steel sheet No. | Steel No. | Heating temperature (° C.) | Temperature at completion of finish rolling (° C.) | Type* | Average cooling rate** (° C./s) | Cooling stopping temperature (° C.) | Winding Winding temperature (° C.) | Sheet thickness (mm) | Remarks |
| 1 | A | 1260 | 920 | Rapid cooling | 50 | 700 | 620 | 2 | Adaptable example |
| 1A | A | 1260 | 920 | Rapid cooling | 50 | — | 710 | 2 | Comparative example |
| 2 | A | 1260 | 850 | Rapid cooling | 50 | 700 | 620 | 2 | Adaptable example |
| 3 | A | 1260 | 900 | Rapid cooling | 30 | 700 | 670 | 2 | Adaptable example |
| 4 | A | 1260 | 900 | Rapid cooling | 70 | 700 | 550 | 2 | Adaptable example |
| 5 | A | 1050 | 920 | Rapid cooling | 50 | 700 | 620 | 2 | Comparative example |
| 6 | A | 1260 | 790 | Rapid cooling | 40 | 700 | 620 | 2 | Comparative example |
| 7 | A | 1260 | 920 | Air cooling | 25 | — | 710 | 2 | Comparative example |
| 8 | A | 1260 | 920 | Rapid cooling | 100 | 550 | 490 | 2 | Comparative example |
| 9 | B | 1260 | 920 | Rapid cooling | 50 | 700 | 620 | 2 | Adaptable example |
| 10 | C | 1260 | 920 | Rapid cooling | 50 | 700 | 620 | 2 | Adaptable example |

TABLE 2-continued

| Steel sheet No. | Steel No. | Hot rolling: Heating temperature (° C.) | Hot rolling: Temperature at completion of finish rolling (° C.) | Cooling: Type* | Cooling: Average cooling rate** (° C./s) | Cooling: Cooling stopping temperature (° C.) | Winding Winding temperature (° C.) | Sheet thickness (mm) | Remarks |
|---|---|---|---|---|---|---|---|---|---|
| 11 | D | 1260 | 920 | Rapid cooling | 50 | 700 | 620 | 2 | Comparative example |
| 12 | E | 1260 | 920 | Rapid cooling | 50 | 700 | 620 | 2 | Comparative example |
| 13 | F | 1260 | 920 | Rapid cooling | 50 | 700 | 620 | 2 | Comparative example |
| 14 | G | 1260 | 920 | Rapid cooling | 50 | 700 | 620 | 2 | Comparative example |

*Air cooling or rapid cooling

**Average cooling rate from the temperature at completion of finish rolling to 700° C. (when the winding temperature >700° C., average cooling rate to the winding temperature)

TABLE 3

| Steel sheet No. | Steel No. | Structure: Type* | Structure: Structure fraction of F (% by area) | Structure: Average crystal grain diameter of F (μm) | Structure: Amount of solute V (% by mass) | Structure: Metallic element contained in precipitates | Average grain diameter of precipitates (nm) | Tensile properties: Yield strength YS (MPa) | Tensile properties: Tensile strength TS (MPa) | DC magnetic properties: $B_{50}$ (T) | DC magnetic properties: $B_{100}$ (T) | Remarks |
|---|---|---|---|---|---|---|---|---|---|---|---|---|
| 1 | A | F | 100 | 2.5 | 0.022 | Ti, V | 4 | 810 | 850 | 1.7 | 1.9 | Inventive example |
| 1A | A | F | 100 | 14.0 | 0.003 | Ti, V | 14 | 660 | 690 | 1.1 | 1.5 | Comparative example |
| 2 | A | F | 100 | 3.5 | 0.023 | Ti, V | 5 | 770 | 810 | 1.6 | 1.8 | Inventive example |
| 3 | A | F | 100 | 6.4 | 0.014 | Ti, V | 6 | 730 | 760 | 1.6 | 1.8 | Inventive example |
| 4 | A | F + B | 95 | 2.4 | 0.022 | Ti, V | 3 | 710 | 750 | 1.7 | 1.9 | Inventive example |
| 5 | A | F | 100 | 2.6 | 0.004 | Ti, V | 14 | 690 | 720 | 1.1 | 1.3 | Comparative example |
| 6 | A | F | 100 | 1.9 | 0.003 | Ti, V | 15 | 670 | 700 | 1.2 | 1.5 | Comparative example |
| 7 | A | F | 100 | 14.5 | 0.003 | Ti, V | 14 | 660 | 690 | 1.1 | 1.5 | Comparative example |
| 8 | A | F + B | 55 | 2.0 | 0.033 | Ti, V | 2 | 670 | 710 | 1.2 | 1.4 | Comparative example |
| 9 | B | F | 100 | 3.2 | 0.032 | Ti, V | 3 | 780 | 820 | 1.7 | 1.9 | Inventive example |
| 10 | C | F | 100 | 2.8 | 0.021 | Ti, V, Nb, Mo | 3 | 800 | 840 | 1.6 | 1.8 | Inventive example |
| 11 | D | F | 100 | 2.8 | 0.004 | Ti, V | 3 | 590 | 620 | 1.3 | 1.5 | Comparative example |
| 12 | E | F | 100 | 2.3 | 0.024 | Ti, V | 20 | 640 | 670 | 1.2 | 1.4 | Comparative example |
| 13 | F | F | 100 | 2.3 | 0.051 | Ti, V | 28 | 650 | 680 | 1.2 | 1.4 | Comparative example |
| 14 | G | F | 100 | 2.8 | 0.004 | Ti, V | 14 | 680 | 720 | 1.3 | 1.5 | Comparative example |

*F: ferrite, B: bainite, M: martensite, P: perlite

All the inventive examples have high strength with a yield strength YS in the rolling direction of 700 MPa or more and further have excellent magnetic properties satisfying a magnetic flux density $B_{50}$ of 1.5 T or more and a magnetic flux density $B_{100}$ of 1.6 T or more. The comparative examples showed a yield strength YS in the rolling direction of less than 700 MPa, a magnetic flux density $B_{50}$ of less than 1.5 T, or a magnetic flux density $B_{100}$ of less than 1.6 T, thus failing to have both the desired strength and the excellent magnetic properties.

Although the embodiments to which the invention achieved by the inventors is applied are described, the present invention is not limited by the description constituting part of the disclosure of the present invention by the present embodiments. In other words, other embodiments, examples, and operating techniques performed by those skilled in the art based on the present embodiments are all included in the scope of the present invention.

The present invention can provide a hot-rolled steel sheet for a generator rim that has both high strength with a yield strength YS in a rolling direction of 700 MPa or more and excellent magnetic properties with a magnetic flux density $B_{50}$ of 1.5 T or more and a magnetic flux density $B_{100}$ of 1.6 T or more without a large content of expensive alloy elements with a relatively inexpensive component range and a method for manufacturing the same.

The invention claimed is:

1. A hot-rolled steel sheet for a generator rim, the hot-rolled steel sheet comprising:

a composition comprising: in terms of percent by mass, C: 0.03% or more and 0.11% or less, Si: 0.3% or less, Mn: 1.0% or more and 2.0% or less, P: 0.06% or less, S: 0.01% or less, Al: 0.06% or less, N: 0.006% or less, Ti: 0.06% or more and 0.21% or less, V: 0.05% or more and 0.12% or less; solute V with a content of 0.005% or more; and the balance of Fe and inevitable impurities and excluding Mo; and a structure comprising a ferrite phase having an areal ratio of 95% or more in which precipitates containing Ti and V whose average grain diameter is less than 10 nm are precipitated in crystal grains of the ferrite phase, wherein the ferrite phase has an average crystal grain diameter within a range of 2 μm or more and less than 10 μm, and the hot-rolled steel sheet has strength with a yield strength YS in a rolling direction of 700 MPa or more and electromagnetic properties with a magnetic flux density $B_{50}$ of 1.5 T or more and a magnetic flux density $B_{100}$ of 1.6 T or more.

2. The hot-rolled steel sheet for a generator rim according to claim 1, wherein the structure comprises a ferrite phase with an areal ratio of 95% or more in which precipitates further containing Nb in addition to Ti and V whose average grain diameter is less than 10 nm are precipitated in crystal grains of the ferrite phase.

3. The hot-rolled steel sheet for a generator rim according to claim 2, wherein the composition further comprises, in terms of percent by mass, Nb: 0.08% or less.

* * * * *